US008323043B2

(12) United States Patent
Dennes et al.

(10) Patent No.: US 8,323,043 B2
(45) Date of Patent: Dec. 4, 2012

(54) ELECTRICAL CONNECTOR HAVING MOVABLE SHIELD TO PROTECT ELECTRICAL CONTACTS

(75) Inventors: Wayne William Dennes, Wyoming (AU); Scott David Lee, Terrigal (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 13/061,462

(22) PCT Filed: Jul. 31, 2009

(86) PCT No.: PCT/AU2009/000978

§ 371 (c)(1), (2), (4) Date: May 20, 2011

(87) PCT Pub. No.: WO2010/022436

PCT Pub. Date: Mar. 4, 2010

(65) Prior Publication Data

US 2011/0212635 A1 Sep. 1, 2011

(30) Foreign Application Priority Data

Aug. 29, 2008 (AU) ..... 2008904500

(51) Int. Cl.
*H01R 13/44* (2006.01)

(52) U.S. Cl. ..... 439/136

(58) Field of Classification Search ..... 439/136, 439/352–358, 157, 484, 489
See application file for complete search history.

(56) References Cited

U.S. PATENT DOCUMENTS

| | | | | |
|---|---|---|---|---|
| 5,338,227 | A | 8/1994 | Nakamura | |
| 5,820,398 | A | 10/1998 | Stabroth et al. | |
| 6,159,020 | A | 12/2000 | Baker et al. | |
| 6,227,886 | B1 | 5/2001 | Baker et al. | |
| 6,231,358 | B1 | 5/2001 | Kerr, Jr. et al. | |
| 6,322,386 | B1 | 11/2001 | Tharp et al. | |
| 7,066,746 | B1 * | 6/2006 | Togami et al. | 439/157 |
| 7,118,281 | B2 * | 10/2006 | Chiu et al. | 385/53 |
| 7,186,134 | B2 * | 3/2007 | Togami et al. | 439/484 |
| 7,232,331 | B2 | 6/2007 | Dennes et al. | |
| 7,255,484 | B2 * | 8/2007 | Walker et al. | 385/53 |
| 7,314,384 | B2 * | 1/2008 | Togami et al. | 439/484 |
| 7,507,111 | B2 * | 3/2009 | Togami et al. | 439/484 |
| 7,544,080 | B2 * | 6/2009 | Giefers | 439/352 |
| 2010/0048059 | A1 | 2/2010 | Lee | |
| 2011/0014818 | A1 | 1/2011 | Carter et al. | |

FOREIGN PATENT DOCUMENTS

| | | |
|---|---|---|
| EP | 1 220 370 | 7/2002 |
| WO | WO 2008/119370 | 10/2008 |

OTHER PUBLICATIONS

International Search Report from PCT/AU2009/000978 dated Sep. 4, 2009 (Form PCT/ISA/210).

* cited by examiner

*Primary Examiner* — Chandrika Prasad
(74) *Attorney, Agent, or Firm* — Merchant & Gould P.C.

(57) ABSTRACT

An electrical connector, comprising a connector body having an opening for receiving an electrical cable, a connector element disposed at least partly within the connector body and electrically coupleable to the electrical cable, an insulating shield operably associated with the connector body and movable between a first position, in which an electrical contact portion of the connector element is exposed for direct contact, and a second position, in which the insulating shield covers the electrical contact portion to limit direct contact with the electrical contact portion, and a catch mechanism for retaining the insulating shield in the second position, the catch mechanism having an actuable portion for releasing the insulating shield for movement to the first position.

21 Claims, 10 Drawing Sheets

158

ELECTRICAL CONNECTOR HAVING MOVABLE SHIELD TO PROTECT ELECTRICAL CONTACTS

This application is a National Stage Application of PCT/AU2009/000978, filed 31 Jul. 2009, which claims benefit of Ser. No. 2008904500, filed 29 Aug. 2008 in Australia and which applications are incorporated herein by reference. To the extent appropriate, a claim of priority is made to each of the above disclosed applications.

FIELD

The described embodiments relate to electrical connectors. In particular, the described embodiments relate to electrical connectors having a movable protective shield.

BACKGROUND

Electrical connectors connected to an electrical cable provide a convenient tool for making and breaking electrical connections with the cable. Electrical connectors may have contacts exposed in order to make an electrical connection. However, there is considerable risk to a user when using a connector with exposed contacts, and particularly, the risk of electric shock resulting from the user's inadvertent contact with a connector's exposed contacts when used to supply an electric current.

It is desired to address or ameliorate one or more disadvantages or shortcomings of existing connectors or to at least provide a useful alternative thereto.

SUMMARY

Certain embodiments relate to an electrical connector, comprising:

an electrical connector, comprising:

a connector body having an opening for receiving an electrical cable;

a connector element disposed at least partly within the connector body and electrically coupleable to the electrical cable;

an insulating shield operably associated with the connector body and movable between a first position, in which an electrical contact portion of the connector element is exposed for direct contact, and a second position, in which the insulating shield covers the electrical contact portion to limit direct contact with the electrical contact portion; and a catch mechanism for retaining the insulating shield in the second position, the catch mechanism having an actuable portion for releasing the insulating shield for movement to the first position.

The actuable portion may be located on the connector body or on the insulating shield and may be integrally formed therewith. The catch mechanism may rely on interference between a first portion of the connector body and a second portion of the insulating shield to retain the insulating shield in the second position, such that actuation of the actuable portion reduces or removes the interference. The actuable portion may be resiliently deflectable.

The insulating shield may be transparent and may be formed of polycarbonate. The actuable portion and/or the connector body may also be formed of polycarbonate. The connector body may be formed of an opaque insulating material.

The connector may also comprise a biasing member, such as a spring, for biasing the insulating shield towards the second position.

The catch mechanism may comprise an anchor portion by which the actuable portion is coupled to one of the insulating shield and the connector body and may comprise a catch portion that contacts an other one of the connector body and the insulating shield to retain the insulating shield in the second position. The catch portion may be moveable in response to actuation of the actuable portion to release the insulating shield for movement to the first position. The actuable portion and the catch portion may be disposed on opposite sides of the anchor portion so that deflection of the actuable portion in one direction results in deflection of the catch portion in an opposite direction. Alternatively, the actuable portion and the catch portion may be disposed on a same side of the anchor portion, so that deflection of the actuable portion in one direction results in deflection of the catch portion in the one direction.

The insulating shield may be movable in a longitudinal direction and the actuable portion may be disposed toward a lateral centre or lateral side of the connector body. When the insulating shield is in the first position, the actuable portion may be substantially covered by the insulating shield. The connector body may comprise a first part that is substantially covered by the insulating shield in the second position and a second part that is substantially uncovered by the insulating shield in the second position. The actuable portion may be located on the first part of the connector body or on the second part of the connector body.

BRIEF DESCRIPTION OF THE DRAWINGS

Embodiments are described below in further detail and by way of example, with reference to the accompanying drawings wherein.

DETAILED DESCRIPTION

Figure 1:
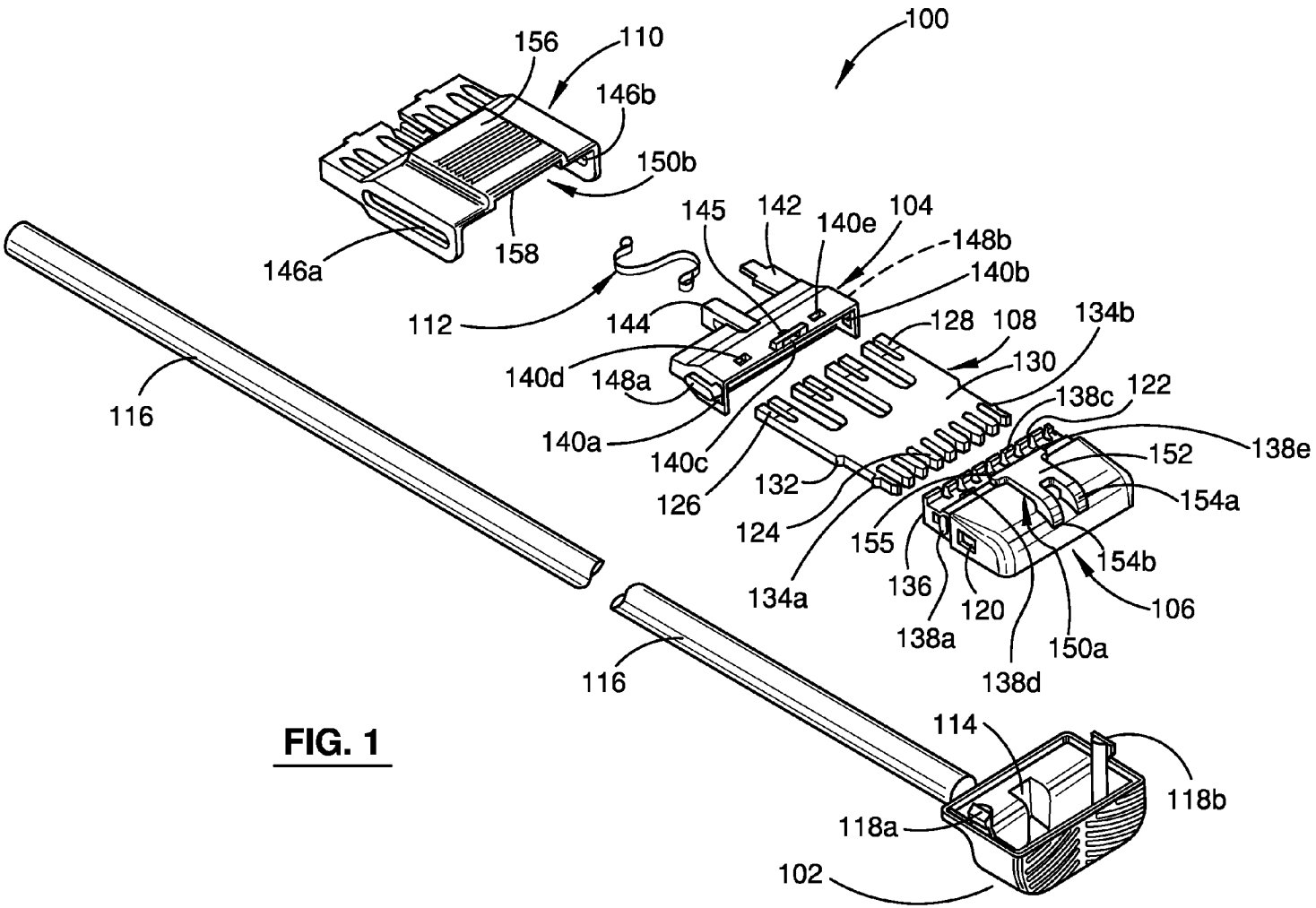
FIG. 1 is an exploded perspective view of an electrical connector.

The described embodiments relate generally to electrical connectors having a movable shield for covering electrical contacts of the connector and comprising a catch mechanism tending to retain the shield in an extended position in which it covers the contacts. The catch mechanism is actuable by a person's finger so as to release the shield for movement from the extended position towards a retracted position. Various embodiments are described herein, in which the catch mechanism is implemented in different ways.

Generally, the embodiments of electrical connectors described herein comprise a catch mechanism. While the catch mechanism of each embodiment is implemented in different ways, each implementation of the catch mechanism has an actuable part and a non-actuable part. The actuable part may be located on one of the connector body and the insulating shield, while the non-actuable part may be located on the other one of the connector body and the insulating shield. The non-actuable portion may comprise a passive catch or edge portion that interferes with the moveable actuable portion to prevent retraction of the insulating shield in its extended position.

The actuable portion generally has an anchor by which it is coupled to a part of the connector body or to the insulating shield (depending on the embodiment), an actuable portion and a catch portion, all integrally formed with the part of the connector body or insulating shield to which the actuable portion is coupled. The actuable portion and the catch portion may be formed on the same or opposite sides of the anchor portion. In some embodiments, the catch portion and the actuable portion may comprise the same part of the actuable part of the catch mechanism. In all embodiments, the actuable part is resiliently deflectable to release the insulating shield for movement to the retracted position.

In the following description of the drawings, like reference numerals are used to indicate like parts, features or functions as between the drawings. Additionally, similar reference numerals are used to indicate similar features and/or functions as between different embodiments whenever possible. For example, a raised portion of the shield is designated by reference numerals 156, 1256 and 1656 for electrical connector embodiments 100, 1200 and 1600. Similarly, the catch portion is designated by reference numerals 152, 752, 1152, 1252 and 1652 for electrical connector embodiments 100, 700, 1100, 1200, and 1600. Thus, unless the context indicates otherwise, where a reference numeral for parts or elements shown in different embodiments uses the same last two digits, this is intended to indicate a like or analogous feature and/or function among the indicated elements.

The electrical connector 100, as shown in FIG. 1, includes a connector body having a first member 102 and a second member which is made up of an upper shell 106 and a lower shell 104. Connector 100 further includes an electrical connector element 108, an insulation shield 110 and a biasing means 112, such as a spring. The first member 102 has an opening 114 formed through the member 102 for receiving one or more wires from an electric cable 116. The connector 100 can be used with any type of electric cable 106. For example, the cable 116 may be a single-cored cable, or a multi-cored cable with wires corresponding to one or more twisted pairs.

The first member 102 has latching means formed on an inner surface of the member 102. The latching means includes one or more resilient latching posts 118*a* and 118*b*, each having an enlarged head portion which includes a shoulder that gradually increases the cross-sectional thickness of the head portion in a direction away from the exposed end of the latching post 118*a* and 118*b*. The head portion includes a flanged portion formed substantially normal to the length of the latching post 118*a* and 118*b*, which defines the transition from the larger cross-sectional thickness of the head portion to a smaller cross-sectional thickness of the latching post 118*a* and 118*b*. The latching posts 118*a* and 118*b* on the first member 102 are aligned with a corresponding recess 120 formed in the upper shell 106 of the second member. When the first member 102 and second member 104, 106 are coupled together, the head portion of a latching post 118*a* and 118*b* engages within a respective recess 120 in the upper shell 106 so that the resilience of the latching posts 118*a* and 118*b* securely holds the first member 102 and upper shell 106 together.

The first member 102 and the upper shell 106 of the second member, when coupled together, define a cavity between the parts 102 and 106. The upper shell 106 of the second member includes one or more wiring slots 122, each for receiving the stripped end of a respective wire from the cable 116. When the stripped ends of wires are held in place by the wiring slots 122, the contact slots 124 formed on the electrical connector element 108 can engage with a corresponding stripped end of a wire within the cavity to establish electrical contact. For example, each contact slot 124 includes a surface made of a conducting material (e.g. copper) for directly contacting and making an electrical connection with the stripped end of a wire (not shown) held in place by a wiring slot 122 of upper shell 106. The size of each contact slot 124 is sufficiently small to securely grip the stripped end of a wire.

The connector element 108 includes one or more fingers 126, each finger 126 having a contact portion 128 for making electrical contact. The connector element 108 is substantially flat and has conducting paths (not shown) formed on the upper surface 130 and/or the lower surface 132 to provide an electrical connection between each contact slot 124 with a respective contact portion 128 of a finger 126. The connector element 108 may be a printed circuit board with etched conducting paths on one or both sides 130, 132. In the arrangement shown in FIG. 1, the contact slots 124 for receiving wires of a twisted pair are connected by conducting paths to respective contact portions 128 on adjacent fingers 126.

The connector element 108 is made for mating assembly with the upper shell 106. The connector element 108 includes one or more retaining notches 134*a* and 134*b* that engages with a corresponding retaining recess 136 formed in the upper shell 106 to securely couple the parts 106 and 108 together. The upper shell 106 has one or more protrusions 138*a*, 138*b*, 138*c*, 138*d* and 138*e* that engages with a corresponding recess 140*a*, 140*b*, 140*c*, 140*d* and 140*e* formed in lower shell 104 to securely couple the parts 104 and 106 together.

The adjustable insulation shield 110 is made of a non-conductive material (e.g. polycarbonate or polyvinyl-chloride), and has one or more guiding slots 146*a* and 146*b* formed in the shield 110. In some embodiments, as shown in FIG. 1, the guiding slots 146*a* and 146*b* are formed through sidewalls of the shield 110. In other embodiments, the guiding slots 146*a* and 146*b* may comprise recesses formed on the inner surface of the shield 110 but not formed through the sidewalls of the shield 110.

The guiding slots 146*a* and 146*b* engage with a corresponding guiding protrusion 148*a* and 148*b* formed on the outer surface of the lower shell 104, so that the shield 110 is able to move by sliding relative to the second member 104, 106, and wherein the movement of the shield 110 is guided by the guiding protrusions 148*a* and 148*b*. The guiding protrusions 148*a* and 148*b* are sufficiently long and snugly received in slots 146*a* and 146*b* so as to maintain stability of the shield 110 during movement.

The shield 110 is moveable along the length of the second member 104, 106 between an extended second position and a retracted first position, such that when the shield 110 returns to the first position, the contact portions 128 of the fingers 126 are exposed for direct contact. When the shield 110 is moved to the second position, the shield covers the contact portions 128 of the fingers 126 to minimise direct contact with the contact portions 128.

The electrical connector 100 includes biasing means 112 that tends to move the shield 110 towards the second position. The biasing means 112 may include a suitable form of compression spring, and may specifically comprise an S-shaped spring as shown in FIG. 1. The biasing means 112 is positioned between the shield 110 and the lower shell 104 of the second member, and the biasing means 112, when compressed, pushes against a boss portion 145 of the lower shell 104 and an inner wall of the shield 110 to bias the shield 110 towards the second position. The S-shaped spring shown in FIG. 1 has one end registered with boss portion 145 and has its other end registered with another boss portion (not shown) on shield 110 so that the spring is retained in position during compression and expansion.

A u-shaped supporting portion 144 on lower shell 104 is positioned to mate with a complimentary u-shaped slot extending centrally in the direction of contact portions 128 on connector element 108. When connector 100 is assembled, supporting portion 144 assists in holding connector element 108 in place within the connector body. A keying finger 142 extends from lower shell 104 and aids in ensuring electrical connector 100 is correctly terminated at a patch panel.

As shown in FIG. 1, insulating shield 110 has a raised portion 156 on a top part of the shield 110. Raised portion 156 defines a cavity underneath it for receiving and accommodating the biasing means 112. Raised portion 156 has an edge portion 158 disposed in a direction away from those parts of shield 110 that receive and accommodate fingers 126 of connector element 108.

As shown in FIG. 1, connector 100 comprises a catch mechanism 150*a*, 150*b* by which at least part of the connector body, such as upper shell 106, is positioned to interfere with a part of the insulating shield 110 so as to prevent retraction of shield 110 unless the catch mechanism is actuated to release shield 110 for movement relative to the connector body. The catch mechanism illustrated in FIG. 1 comprises an actuable part 150*a* having an actuable portion 152 coupled to upper shell 106 via anchor portions 154*a* and 154*b*. Actuable portion 152 also acts as a catch portion and is resiliently deflectable relative to anchor portions 154*a* and 154*b* under the action of a finger or thumb so as to move closer to, or lie against, an upper surface of upper shell 106. Actuable portion 152 may have projecting portions 155 disposed on an abutting edge of the actuable portion to lie under edge portion 158 when shield 110 is in the extended position and the edge of actuable portion 152 abuts edge portion 158. Edge portion 158 acts as a non-actuable part 150*b* of the catch mechanism.

Figure 2:
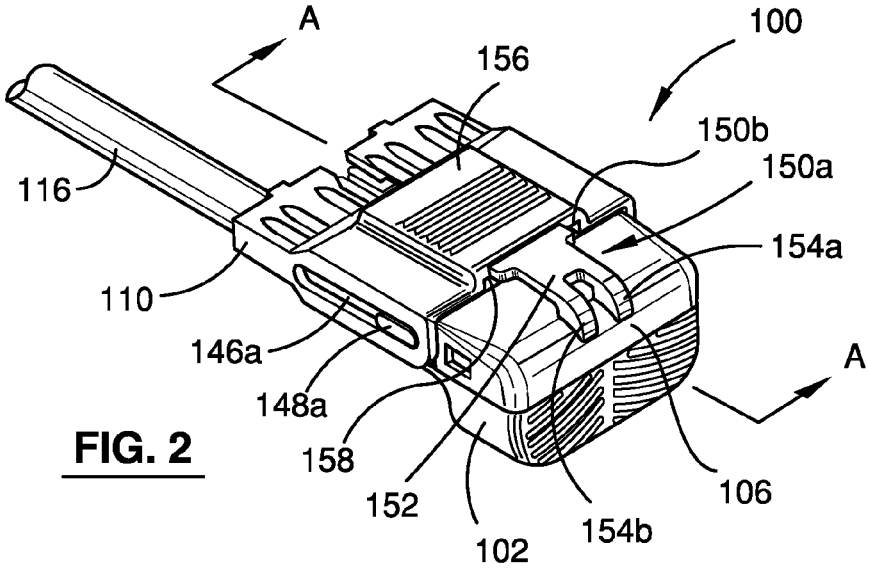
FIG. 2 is a perspective view of the electrical connector with a protective shield in an extended position.
Figure 3:
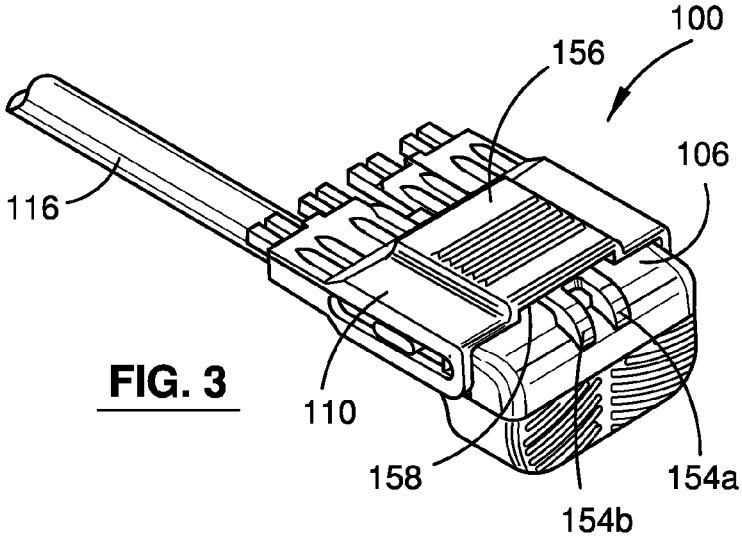
FIG. 3 is a perspective view of the electrical connector with the shield in a partially retracted position.
Figure 4:
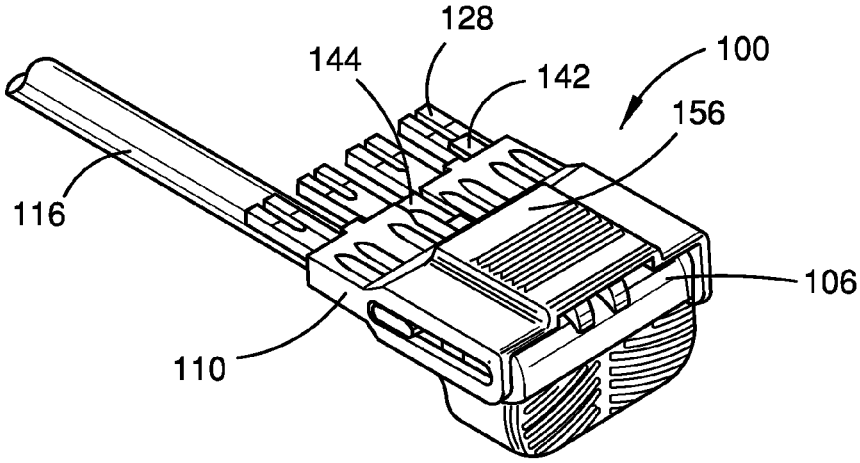
FIG. 4 is a perspective view of the electrical connector with the shield in a fully retracted position.

FIG. 2 is a perspective view of the electrical connector 100 with the shield 110 in the extended second position (i.e. unterminated position). FIG. 3 is a perspective view of the electrical connector 100 with the shield 110 in a partly retracted position intermediate the second position and the first position. FIG. 4 is a perspective view of the electrical connector 100 with the shield 110 in a fully retracted first position (i.e. terminated position). Like numbering in FIGS. 2, 3 and 4 indicates like parts as shown in FIG. 1.

As is illustrated in FIG. 2, in the extended position, the catch portion of actuable portion 152 is in an undeflected position where actuable portion 152 abuts edge portion 158 of shield 110 so that shield 110 cannot be retracted. Upon actuation of catch mechanism 150*a* and 150*b*, for example by depression of actuable portion 152, actuable portion 152 can slide underneath edge portion 158 and into the cavity defined by raised portion 156, in the manner illustrated in FIG. 3. In the example of actuable portion 152 shown in FIGS. 1 and 2, actuable portion 152 has extending lateral wing portions where it abuts edge portion 158 in order to provide for a greater area of abutment between the catch portion of actuable portion 152 and edge portion 158.

Figure 5:
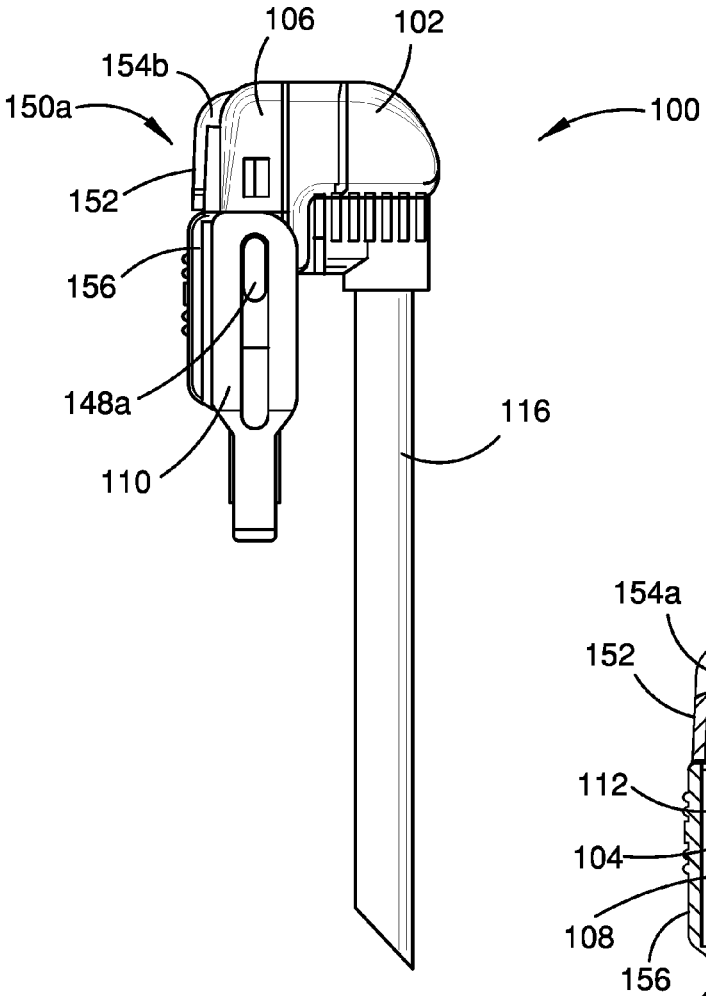
FIG. 5 is a side view of the electrical connector of FIG. 1 when assembled.
Figure 6:
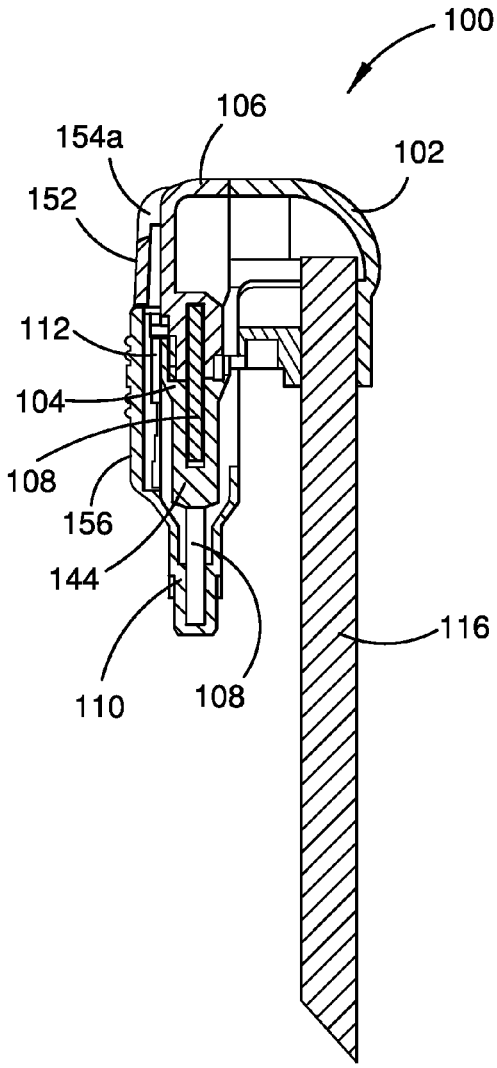
FIG. 6 is a side cross-sectional view of the electrical connector, taken along line A-A of FIG. 2.
Figure 7:
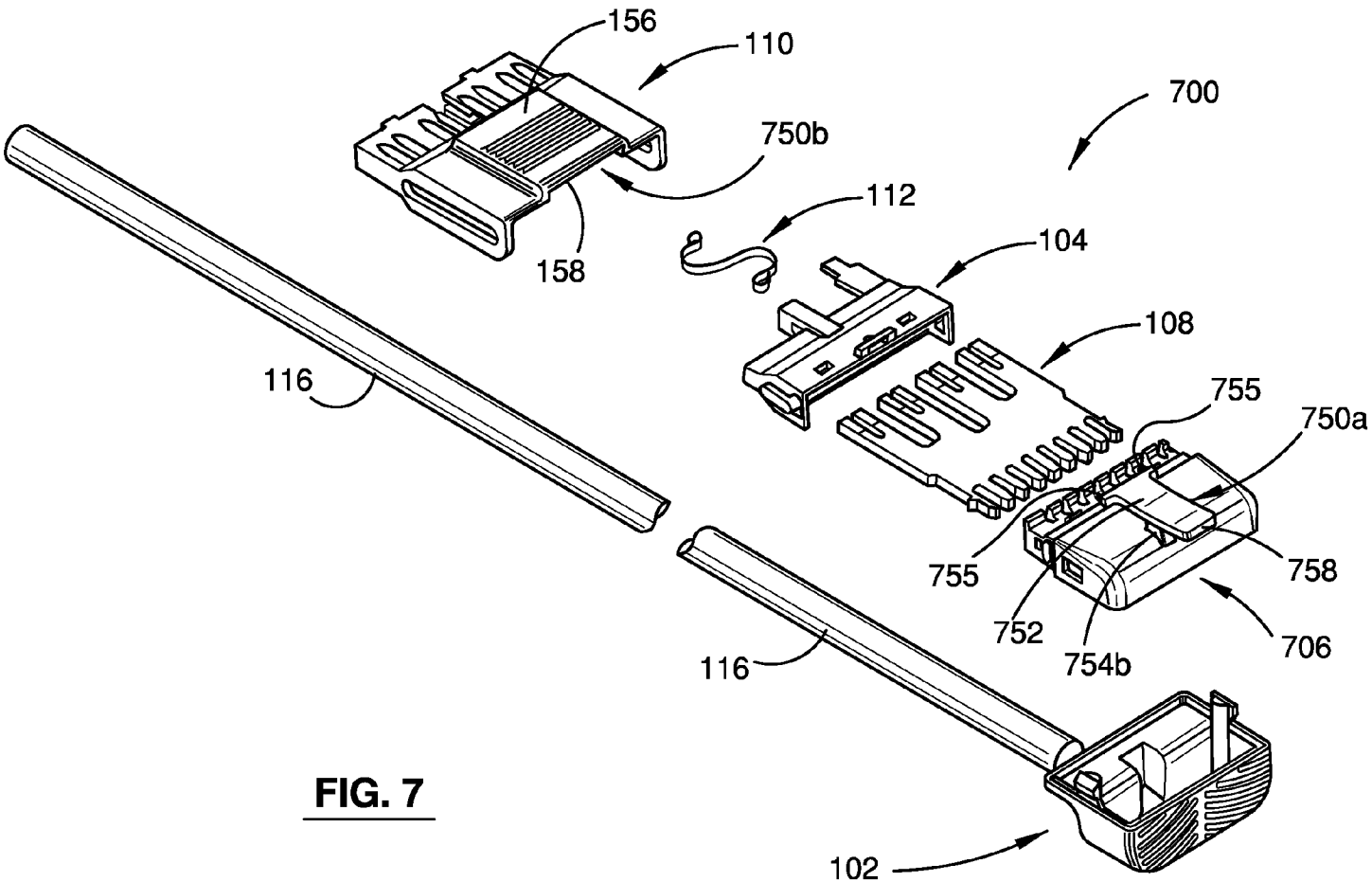
FIG. 7 is an exploded perspective view of another electrical connector.
Figure 8:
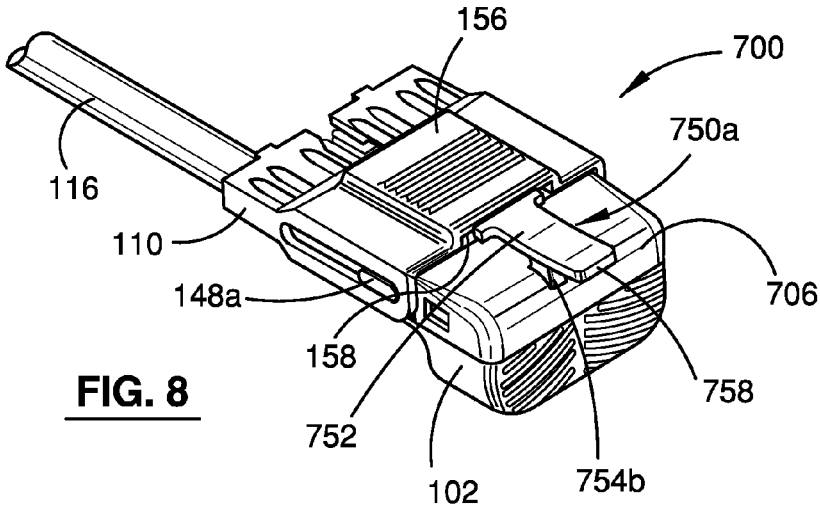
FIG. 8 is a perspective view of the electrical connector of FIG. 7 with the protective shield in an extended position.
Figure 9:
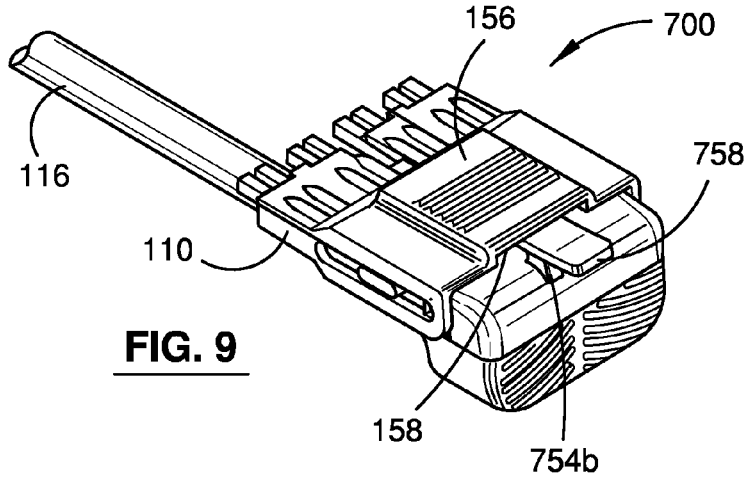
FIG. 9 is a perspective view of the electrical connector of FIG. 7 with the shield in a partially retracted position.
Figure 10:
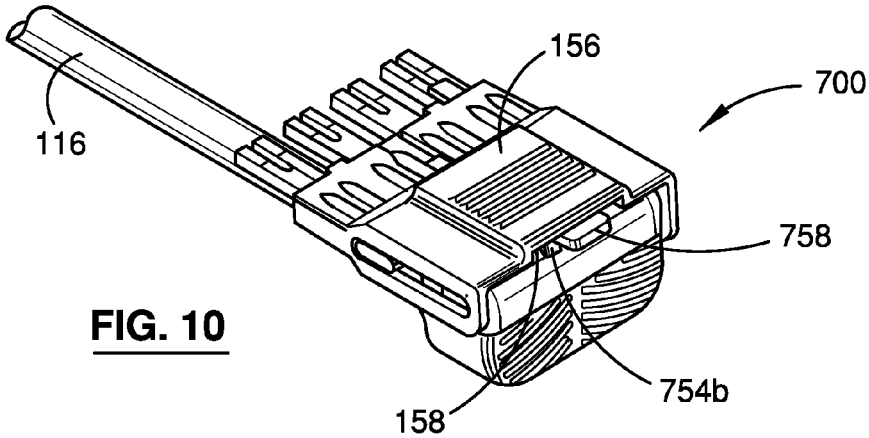
FIG. 10 is a perspective view of the electrical connector of FIG. 7 with the shield in a fully retracted position.

FIGS. 5 and 6 illustrate side views of connector 100, with FIG. 6 being a side cross-section taken along line A-A of FIG. 2. FIGS. 5 and 6 assist in showing the relative orientation and location of the various components of electrical connector 100 described herein. In particular, it is evident from FIGS. 5 and 6 that actuable portion 152 is sufficiently spaced from a surface of upper shell 106 to allow inward deflection of actuable portion 152 upon actuation and thereof and thereby allow raised portion 156 of shield 110 to slide over catch portion 152.

Generally with regard to connector 100 as shown in FIGS. 1 to 6, the first member 102 and the second member 104, 106 can be coupled together in two different orientations with respect to each other, by rotating the first member 102 and the second member 104, 106 through 180° relative to each other along respective planes in parallel to each other. The configuration of the latching posts 118*a* and 118*b* in the first member 102, and their respective alignment with recesses 120 in the upper shell 106, are such that the first and second members 102, 104, 106 can be coupled in either a first configuration or an oppositely orientated second configuration as described above.

Referring now to FIGS. 7 to 10, an electrical connector 700 is shown, having an alternative catch mechanism configuration. Except as described herein in relation to FIGS. 7 to 10, electrical connector 700 is otherwise the same as electrical connector 100. In order to avoid repetitive description of the same features as between the embodiments of electrical connectors 100 and 700, the description of FIGS. 7 to 10 focuses on the modified catch mechanism.

Connector 700 comprises first member 102, lower shell 104, connector element 108, insulating shield 110, biasing member 112 and cable 116, as described above in relation to FIGS. 1 to 6, in combination with a modified upper shell 706.

Upper shell 706 is exactly the same as upper shell 106, except that it has a modified catch mechanism 750*a*, 750*b*. The catch mechanism has an actuable part 750*a* that has a catch portion 752 coupled to upper shell 706 via anchor portions 754*a* and 754*b* and an actuable portion 758 extending away from anchor portions 754*a* and 754*b* in an opposite direction to catch portion 752. With this configuration of catch mechanism 750*a*, 750*b*, release of the catch mechanism 750*a*, 750*b* can occur by pushing outwardly on actuable portion 758 to thereby cause catch portion 752 to deflect inwardly by pivoting relative to anchor portions 754*a* and 754*b*. This inward deflection of catch portion 752 removes the abutting interference of catch portion 752 with edge portion 158 (which acts as a non-actuable part 750*b* of the catch mechanism) and thereby allows retraction of shield 110 in the manner illustrated in FIGS. 9 and 10.

Catch mechanism 750*a*, 750*b* can be released either by outward deflection of actuable portion 758 or by pressing inwardly on catch portion 752. Catch portion 752 has projection portions 755 positioned along the abutting edge thereof to underlie edge portion 158 of shield 110 when shield 110 is in the extended position. Projections 755 can serve to prevent inadvertent deflection of catch portion 752 above edge portion 158.

Figure 11:
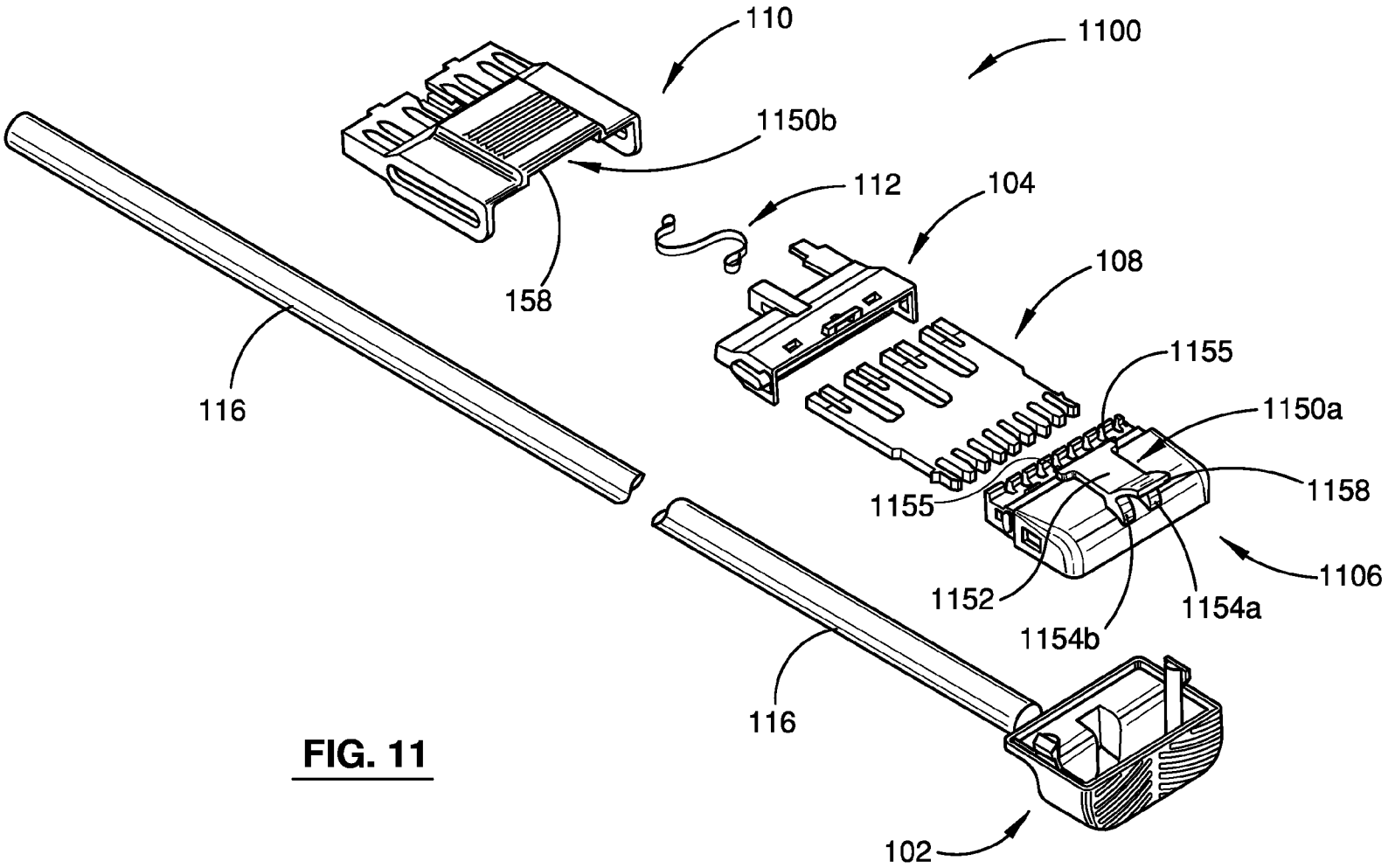
FIG. 11 is an exploded perspective view of another electrical connector having a catch mechanism similar to that shown in FIGS. 7 to 10.
Figure 12:
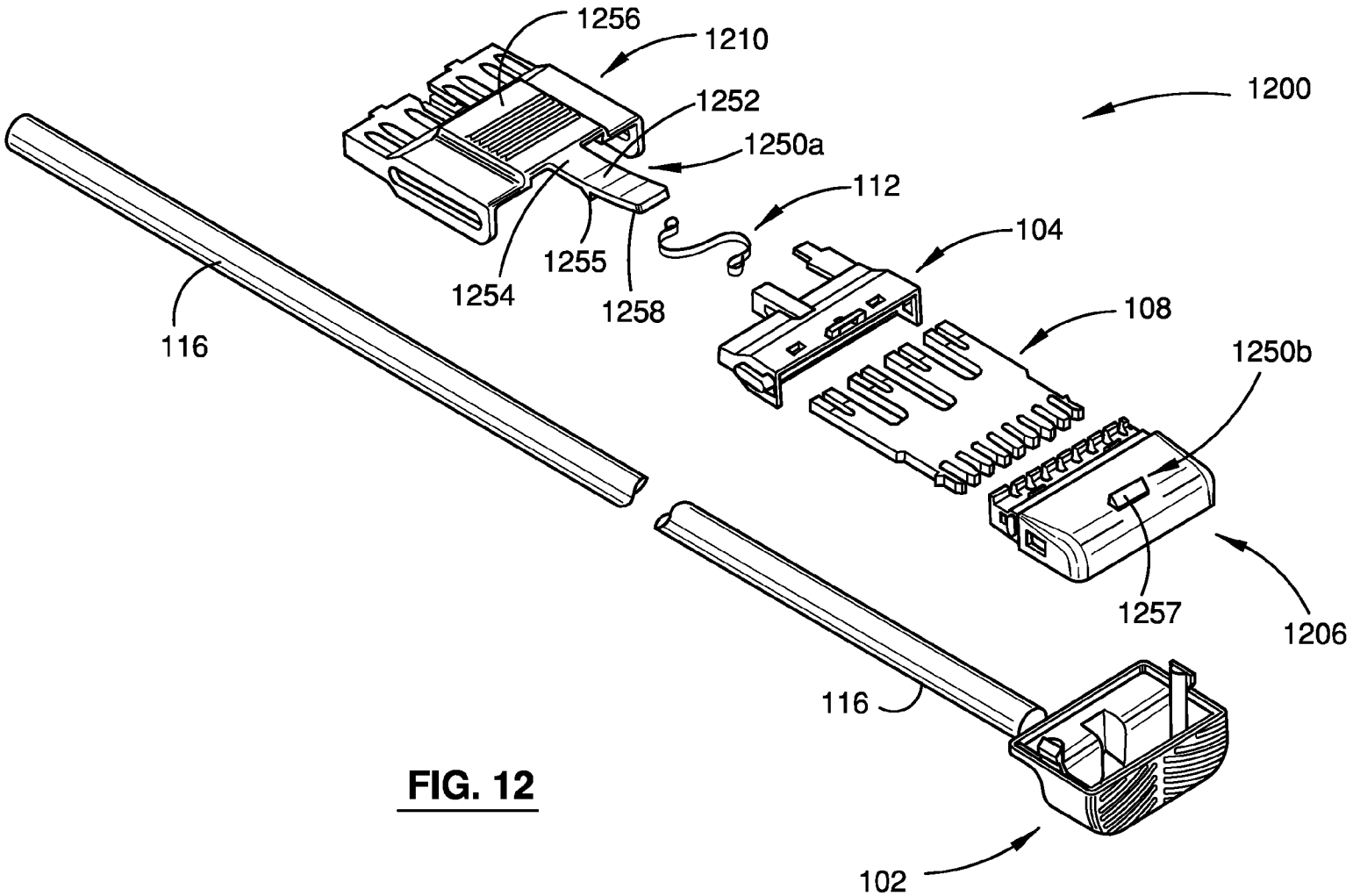
FIG. 12 is an exploded perspective view of yet another electrical connector.

Referring now to FIG. 11, an electrical connector 1100 is shown, having an alternative catch mechanism configuration. Except as described herein in relation to FIG. 11, electrical connector 1100 is otherwise the same as electrical connector 700. In order to avoid repetitive description of the same features as between the embodiments of electrical connectors 700 and 1100, the description of FIG. 11 focuses on the modified catch mechanism.

Connector 1100 comprises first member 102, lower shell 104, connector element 108, insulating shield 110, biasing number 112 and cable 116, as described above in relation to FIGS. 7 to 10, in combination with a modified upper shell 1106.

Upper shell 1106 is exactly the same as upper shell 706, except that it has a modified actuable portion 1158. A catch mechanism 1150*a*, 1150*b* of connector 1100 has a catch portion 1152 coupled to upper shell 1106 via anchor portions 1154*a* and 1154*b* and an actuable portion 1158 extending away from anchor portions 1154*a* and 1154*b* in an opposite direction to catch portion 1152. With this configuration of catch mechanism 1150*a*, 1150*b*, release of the catch mechanism 1150 can occur by pushing outwardly on actuable portion 1158 to thereby cause catch portion 1152 to deflect inwardly by pivoting relative to anchor portions 1154*a* and 1154*b*. This inward deflection of catch portion 1152 removes the abutting interference of catch portion 1152 with edge portion 158 (which acts as a non-actuable part 1150*b* of the catch mechanism) and thereby allows retraction of shield 110 in the manner similar to that illustrated in FIGS. 9 and 10.

Actuable portion 1158 is bent away from upper shell 1106 and is not generally co-planar with catch portion 1152, unlike the generally co-planar orientation of catch portion 752 with actuable portion 758. The bent configuration of actuable portion 1158 may be more readily actuable by a finger or thumb than actuable portion 758.

Catch mechanism 1150*a*, 1150*b* can be released either by outward deflection of actuable portion 1158 or by pressing inwardly on catch portion 1152. Catch portion 1152 has projection portions 1156 positioned along the abutting edge thereof to underlie edge portion 158 of shield 110 when shield 110 is in the extended position. Projections 1156 can serve to prevent inadvertent deflection of actuable portion above edge portion 158.

Referring now to FIGS. 12 to 15, an electrical connector 1200 is shown, having a further alternative catch mechanism 1250*a*, 1250*b* for retaining the insulating shield in the extended position. Electrical connector 1200 is generally the same as electrical connectors 100, 700 and 1100, except that it employs a different catch mechanism 1250*a*, 1250*b*, in which the actuable portion (1258) and catch portion (1252) are located on, and integrally formed with, the insulating shield 1210, rather than on the upper shell.

Figure 13:
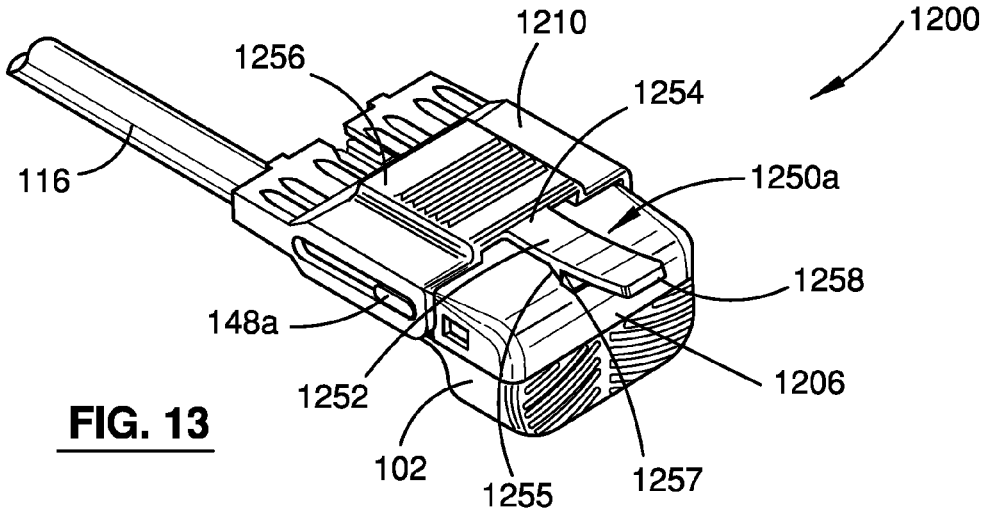
FIG. 13 is a perspective view of the electrical connector of FIG. 12 with the shield in an extended position.

As is illustrated in FIGS. 12 to 15, an actuable part 1250*a* of the catch mechanism extends from a raised portion 1256 of shield 1210. Actuable part 1250*a* extends in a direction opposite to that part of shield 1210 that accommodates fingers 126 of connector element 108. Actuable part 1250*a* resembles a finger that generally overlies upper shell 1206 when shield 1210 is in the extended position. Actuable part 1250*a* has a catch portion 1252 coupled to raised portion 1256 via an anchor portion 1254, with a protruding catch 1255 extending downwardly from catch portion 1252 to interfere with a corresponding catch 1257 (which comprises a non-actuable part 1250*b* of the catch mechanism) positioned on an outer face of upper shell 1206, as shown in FIG. 13.

Figure 14:
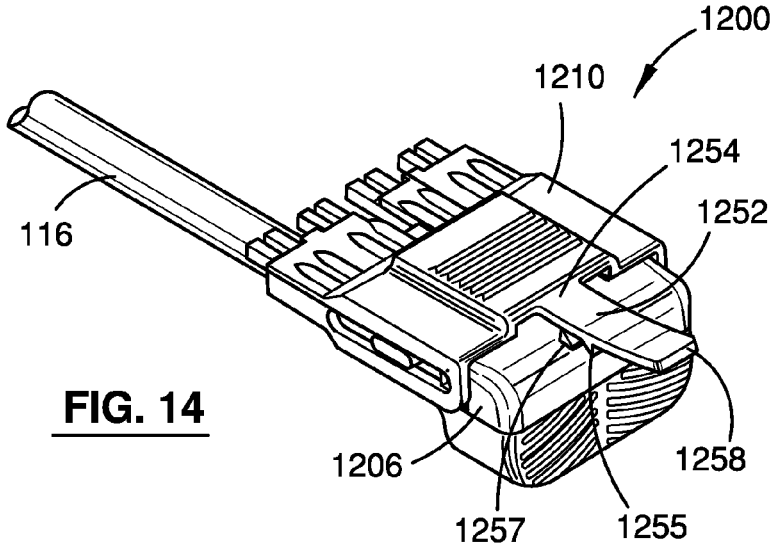
FIG. 14 is a perspective view of the electrical connector of FIG. 12 with the shield in a partially retracted position.
Figure 15:
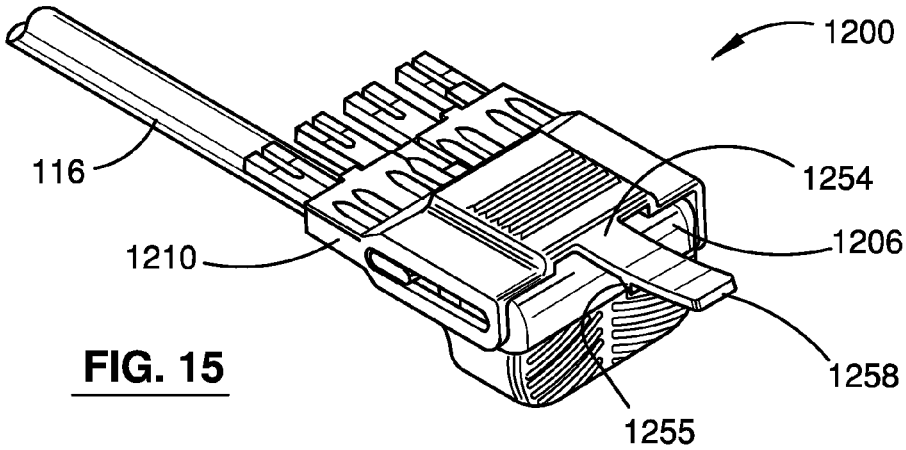
FIG. 15 is a perspective view of the electrical connector of FIG. 12 with the shield in a fully retracted position.

In order to release the catch mechanism 1250*a*, 1250*b*, actuable portion 1258 of actuable part 1250*a* is pushed in a direction away from upper shell 1206 so that catch portion 1252 and catch 1255 are resiliently deflected upwardly and interference between catches 1255 and 1257 is removed or reduced to the extent that shield 1210 is allowed to slide towards the retracted position in the manner illustrated in FIGS. 14 and 15.

Figure 16:
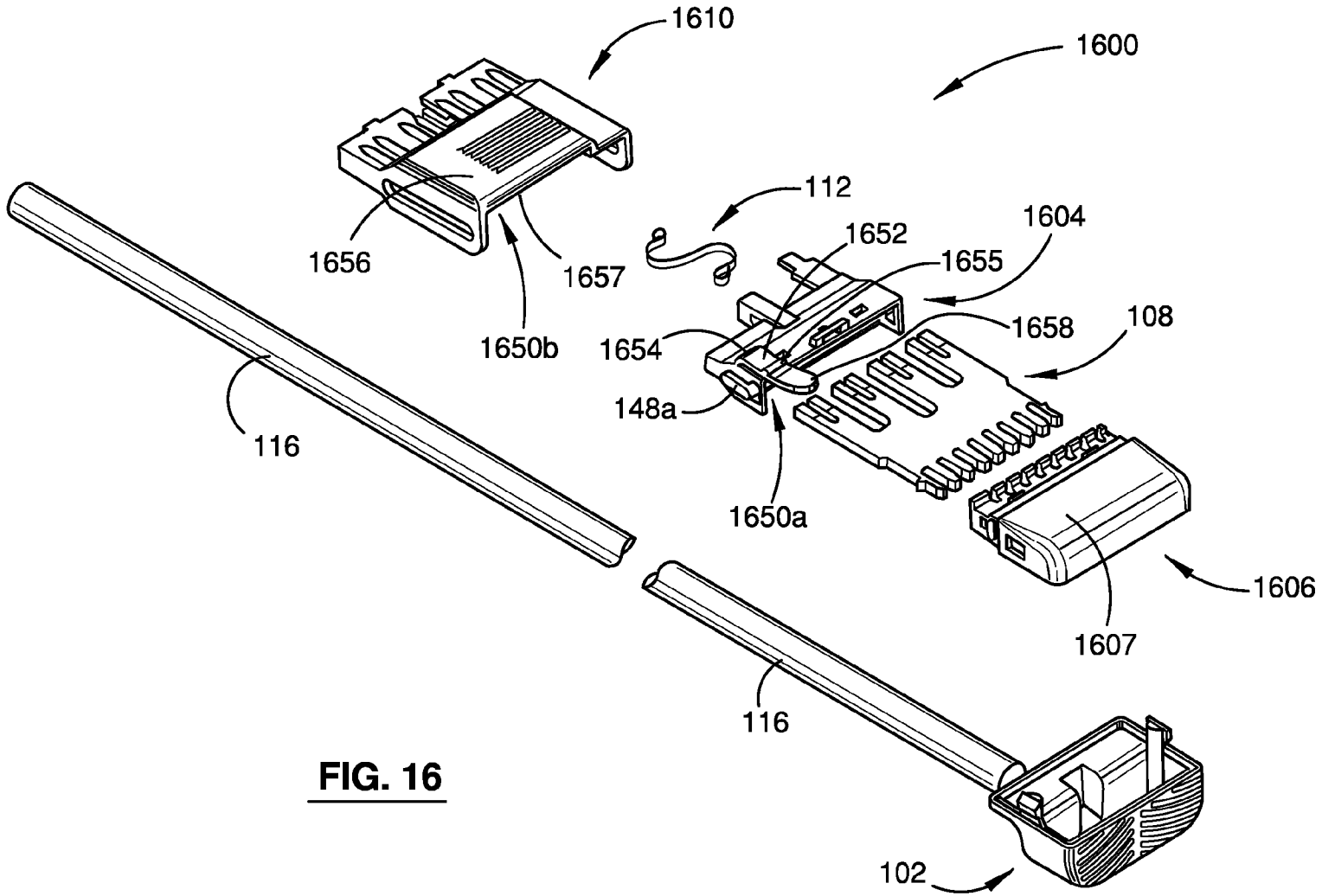
FIG. 16 is an exploded perspective view of yet another electrical connector.
Figure 17:
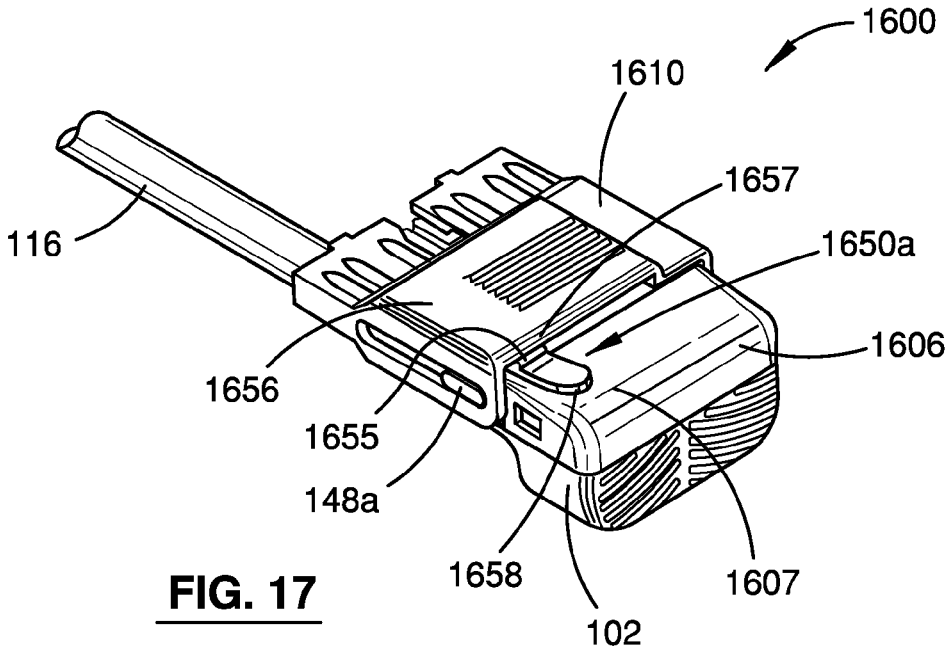
FIG. 17 is a perspective view of the electrical connector of FIG. 16 with the protective shield in an extended position.
Figure 18:
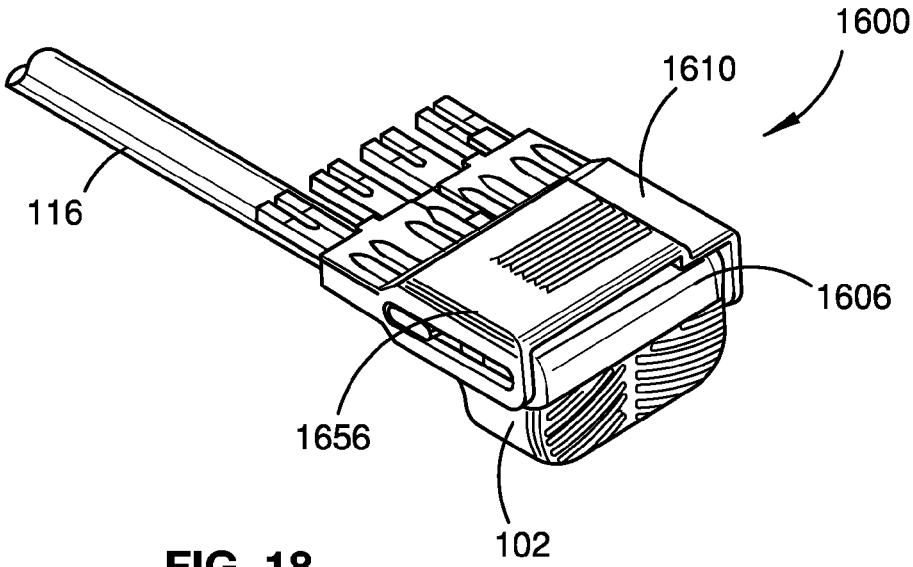
FIG. 18 is a perspective view of the electrical connector of FIG. 16 with the shield in a fully retracted position.

Referring now to FIGS. 16 to 18, an electrical connector 1600 is shown, having a further alternative catch mechanism 1650*a*, 1650*b* for retaining insulating shield 1610 in the extended position. As shown in FIGS. 16 to 18, electrical connector 1600 comprises a catch mechanism having an actuable part 1650*a* on lower shell 1604. In order to accommodate actuable part 1650*a* being located on, and integrally formed with, lower shell 1604, insulating shield 1610 has a laterally enlarged raised portion 1656 defining a laterally enlarged cavity thereunder to accommodate the actuable part 1650*a* of the catch mechanism being positioned on a lateral side of connector 1600. Upper shell 1606 has a bare upper face 1607 as upper shell 1606 is not used to provide any part of the catch mechanism for connector 1600.

As is illustrated in FIG. 17, when connector 1600 has insulating shield 1610 in the extended position, at least part of actuable part 1650*a* is disposed within the cavity defined by raised portion 1656 of shield 1610, with the remainder of actuable part 1650*a* extending away from shield 1610 to overlie upper face 1607 of upper shell 1606. When shield 1610 is in the fully retracted position, as shown in FIG. 18, actuable part 1650*a* is completely covered by raised portion 1656 of shield 1610.

Actuable part 1650*a* has an anchor portion 1654 at which it is connected to lower shell 1604. A catch portion 1652 of actuable part 1650*a* extends away from anchor 1654 and has an outwardly protruding catch 1655 for interfering with, and abutting against, edge portion 1657 (which acts as the non-actuable part 1650*b* of the catch mechanism) of shield 1610 in the extended position. Actuable part 1650*a* further comprises an actuable portion 1658 extending away from catch portion 1652.

Actuable part 1650*a* is resiliently deflectable so that, upon depression of actuable portion 1658, catch 1655 is caused to move away from edge portion 1657 so that interference between actuable part 1650*a* and non-actuable part 1650*b* is removed or reduced to allow retraction of shield 1610.

Modifications of the described embodiments may be apparent to those skilled in the art without departing from the spirit and scope of the embodiments as herein described with reference to the accompanying drawings.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The claims defining the invention are as follows:

1. An electrical connector, comprising:

a connector body having an opening for receiving an electrical cable;

a connector element disposed at least partly within the connector body and electrically coupleable to the electrical cable;

an insulating shield operably associated with the connector body and movable between a first position, in which an electrical contact portion of the connector element is exposed for direct contact, and a second position, in which the insulating shield covers the electrical contact portion to limit direct contact with the electrical contact portion, the insulating shield being coupled to the connector body while in the first position and while in the second position; and a catch mechanism for retaining the insulating shield in the second position, the catch mechanism having an actuable portion for releasing the insulating shield for movement to the first position.

2. The connector of claim 1, wherein the actuable portion is located on the connector body.

3. The connector of claim 1, wherein the actuable portion is integrally formed with the connector body.

4. The connector of claim 1, wherein when the insulating shield is in the first position, the actuable portion is substantially covered by the insulating shield.

5. The connector of claim 1, wherein the connector body comprises a first part that is substantially covered by the insulating shield in the second position and a second part that is substantially uncovered by the insulating shield in the second position.

6. The connector of claim 5, wherein the actuable portion is located on the first part of the connector body.

7. The connector of claim 5, wherein the actuable portion is located on the second part of the connector body.

8. The connector of claim 1, wherein the actuable portion is located on the insulating shield.

9. The connector of claim 1, wherein the actuable portion is integrally formed with the insulating shield.

10. The connector of claim 1, wherein the catch mechanism relies on interference between a first portion of the connector body and a second portion of the insulating shield to retain the insulating shield in the second position, and wherein actuation of the actuable portion reduces or removes the interference.

11. The connector of claim 1, wherein the actuable portion is resiliently deflectable.

12. The connector of claim 1, wherein the insulating shield is transparent.

13. The connector of claim 1, wherein the actuable portion is formed of polycarbonate.

14. The connector of claim 1, wherein at least one of the connector body and the insulating shield is formed of polycarbonate.

15. The connector of claim 1, wherein the connector body is formed of an opaque insulating material.

16. The connector of claim 1, further comprising a biasing member for biasing the insulating shield toward the second position.

17. The connector of claim 1, wherein the catch mechanism comprises an anchor portion by which the actuable portion is coupled to one of the insulating shield and the connector body and comprises a catch portion that contacts an other one of the connector body and the insulating shield, to retain the insulating shield in the second position, the catch portion being movable in response to actuation of the actuable portion to release the insulating shield for movement to the first position.

18. The connector of claim 17, wherein the actuable portion and the catch portion are disposed on opposite sides of the anchor portion so that deflection of the actuable portion in one direction results in deflection of the catch portion in an opposite direction.

19. The connector of claim 17, wherein the actuable portion and the catch portion are disposed on a same side of the anchor portion so that deflection of the actuable portion in one direction results in deflection of the catch portion in the one direction.

20. The connector of claim 1, wherein the insulating shield is movable in a longitudinal direction and the actuable portion is disposed toward a lateral centre of the connector body.

21. The connector of claim 1, wherein the insulating shield is movable in a longitudinal direction and the actuable portion is disposed toward a lateral side of the connector body.

* * * * *